US005443118A

United States Patent [19]

Yannimaras et al.

[11] Patent Number: 5,443,118

[45] Date of Patent: Aug. 22, 1995

[54] OXIDANT ENHANCED WATER INJECTION INTO A SUBTERRANEAN FORMATION TO AUGMENT HYDROCARBON RECOVERY

[75] Inventors: Demetrios V. Yannimaras, Tulsa; Mark F. Spencer, Bixby, both of Okla.

[73] Assignee: Amoco Corporation, Chicago, Ill.

[21] Appl. No.: 267,415

[22] Filed: Jun. 28, 1994

[51] Int. Cl.[6] ..... E21B 43/243

[52] U.S. Cl. ..... 166/251; 166/261

[58] Field of Search ..... 166/251, 260, 261, 272

[56] References Cited

U.S. PATENT DOCUMENTS

| | | | |
|---|---|---|---|
| 2,871,941 | 2/1959 | Allen | 166/261 |
| 3,497,000 | 2/1970 | Hujsak et al. | 166/59 |
| 3,504,745 | 4/1970 | Elkins | 166/261 |
| 3,530,940 | 9/1970 | Dauben et al. | 166/305 |
| 4,057,107 | 11/1977 | Pusch et al. | 166/260 |
| 4,234,042 | 11/1980 | Kirkpatrick et al. | 166/261 |
| 4,491,179 | 1/1985 | Pirson et al. | 166/257 |
| 4,552,216 | 11/1985 | Wilson | 166/261 |
| 4,589,487 | 5/1986 | Venkatesan | 166/261 |
| 4,615,391 | 10/1986 | Garthoffner | 166/261 X |
| 4,649,997 | 3/1987 | Bousaid | 166/261 |
| 4,691,773 | 9/1987 | Ward et al. | 166/261 |
| 4,778,010 | 10/1988 | Knecht et al. | 166/261 |
| 4,823,826 | 4/1989 | Sacco | 137/1 |
| 4,834,178 | 5/1989 | Knecht et al. | 166/261 |
| 4,867,238 | 9/1989 | Bayless et al. | 166/261 |
| 4,945,992 | 8/1990 | Sacco | 166/310 |
| 5,027,896 | 7/1991 | Anderson | 166/251 |
| 5,163,753 | 11/1992 | Whiting et al. | 374/10 |

OTHER PUBLICATIONS

M. R. Islam et al., "Improving Waterflood Performance in Oil Reservoirs With Bottomwater", pp. 313–325, a paper presented at the 62nd Annual Technical Conference and Exhibition of the Society of Petroleum Engineers, Dallas, Texas SPE 16727 (Sep. 27–30, 1987).

John Ivory et al., "Low Temperature Oxidation Strategy for Increasing the Effectiveness of Hot Fluid Recovery of Bitumen—An Experimental Study", pp. 50–61, a paper presented at the 1989 Eastern Oil Shale Symposium, Institute for Mining and Minerals Research, University of Kentucky (Nov. 15–17, 1989).

Michael D. Rushing et al., "High Pressure Air Injection", pp. 52–56, Petroleum Engineer (Nov. 1976).

J. T. Moss et al., "Enhanced Oil Recovery Using Hydrogen Peroxide Injection", a paper presented at the Niper/DOE Symposium on In-Situ Combustion, Tulsa, Okla. (Apr. 21–22, 1994).

P. Le Thiez et al., "Injection of An Oxygen-Containing Gas into a Light-Oil Reservoir: Numerical Evaluation of Oil Oxidation and Ignition Phenomena", pp. 65–74, a paper presented at the 6th European IOR-Symposium in Stavanger, Norway (May 21–23, 1991).

D. C. Shallcross, "Ignition Devices and Methods for In-Situ Combustion", pp. 207–237, a paper presented at the III Simposio Internacional Sobre Recuperacion Mejorada De Crudo, Maraciabo, Venezuela (Feb. 19–22, 1989).

M. T. Abasov, et al, "Studies in the Sphere of Construction of Combined Energy-Saving Technologies for Oil Recovery Based on Application of Intrastratal Oxidizing Processes", pp. 543–551, a paper presented at the 5th Hungarian Hydrocarbon Institute's Oil Recovery European Symposium, Budapest, Hungary (1989).

*Primary Examiner*—George A. Suchfield

*Attorney, Agent, or Firm*—Charles P. Wakefield; Robert E. Sloat

[57] ABSTRACT

A method is disclosed for recovering crude oil from a subterranean formation. The invention utilizes the introduction of water containing a salt, which is capable of decomposing to generate an oxidant, into the formation. Decomposition conditions and ignition conditions are established within the formation to cause the salt to decompose and to cause ignition within the formation. The in-situ combustion which results assists in the recovery of crude oil from the formation.

16 Claims, 6 Drawing Sheets

OXIDANT ENHANCED WATER INJECTION INTO A SUBTERRANEAN FORMATION TO AUGMENT HYDROCARBON RECOVERY

FIELD OF THE INVENTION

The invention generally relates to methods for producing hydrocarbons from a subterranean formation. The invention more particularly relates to methods of producing crude oil which utilize water containing a salt which can decompose to generate an oxidant.

BACKGROUND OF THE INVENTION

The oil industry utilizes a variety of methods for recovering oil from subterranean formations. Initially, oil is produced from a formation by pressure depletion. In this method, the differential pressure between the formation and a production well or wells forces the oil contained within the formation toward a production well where it can be recovered. Typically, only about 10 to about 35 percent of the oil which is contained within a formation can be recovered from a formation using pressure depletion. This leaves a large quantity of oil within the formation. Additionally, some formations contain oil which is too viscous to be efficiently recovered from the formation using pressure depletion methods. Because of the need to recover a larger percentage of the original oil-in-place from a formation, several methods have been developed which facilitate the recovery of oil which could not be recovered using pressure depletion techniques. These methods are sometimes hereinafter referred to as "recovery techniques."

Water flooding is the most frequently utilized enhanced recovery technique. In water flooding, water is injected into a formation through an injection well. The injected water moves within the formation and mobilizes the accumulations of oil contained therein. The mobilized oil is moved within the formation toward a production well or wells where it is recovered. Water flooding may be used alone, or it may be combined with other techniques which are performed concurrently with the water flood or subsequent to it. The intent of the techniques are to improve the displacement efficiency of the method so that more of the original oil-in-place can be efficiently recovered from the formation. For example, water flooding may be combined with the injection of a gaseous phase, such as nitrogen, carbon dioxide, air, oxygen, or flue gas. In general, the injected gases mobilize the oil remaining within the formation and make it easier to move the remaining oil toward a production well where it can be recovered. Additionally, materials which tend to block any high permeability paths within a formation may be mixed with the injected water, or chemicals which lower the interfacial tension of oil and water may be added to the injected water to improve the recovery of oil from the formation.

Water flooding is effective at recovering additional hydrocarbons from a formation and is relatively easy to initiate on a field which is operating under pressure depletion. Additionally, the capital requirements for water flooding are less when compared to other enhanced recovery techniques. The displacement efficiency of water flooding, however, is typically not as high as the displacement efficiency of other enhanced recovery techniques, such as in-situ combustion.

Several enhanced recovery techniques utilize thermal energy to enhance the recovery of hydrocarbons from a formation. One such technique utilizes steam injection to enhance the recovery of oil from a formation. Steam injection is generally used to enhance the recovery of oil from formations containing heavy oil. The steam is injected into the formation through an injection well. Once within the formation, the steam heats the oil and reduces the oil's viscosity. This helps the oil to flow to a production well where it can be recovered from the formation. Additionally, the steam increases the pressure within the formation and assists in pushing the oil toward a production well.

Steam injection recovery techniques require on-site facilities for producing the steam utilized by the technique. Also, heavy oil deposits are often underlain by a water layer. The steam injected into such a formation will preferentially sweep the water layer which underlays the formation. This will cause large amounts of steam to be utilized to recover heavy oil from such a formation. Also, a large percentage of the heavy oil contained within the formation is not recoverable due to the failure of the steam to sweep a large region of the formation. Further, for formations located below approximately 600 meters, the heat losses as the steam travels down the wellbore are so large that it becomes economically impractical to use steam injection to enhance the recovery of oil from such a formation.

In-situ combustion is another enhanced recovery technique which, at least in part, utilizes thermal energy to enhance the recovery of oil from a formation. Typically, with in-situ combustion, a gaseous oxidant such as air, oxygen-enriched air, or high purity oxygen is introduced into the formation through an injection well. The injected gaseous oxidant mixes with a portion of the oil present within the formation to form a combustible mixture which may spontaneously ignite if the formation conditions are appropriate. If required, the combustible mixture can be artificially ignited using devices known to one of ordinary skill in the art. The combustion of the gaseous oxidant with oil present within the formation is an exothermic reaction which liberates heat and produces flue gas and steam. At least a portion of the heat liberated is transferred to the remaining uncombusted oil contained within the formation. The heat transferred to the oil mobilizes it and facilitates its movement toward a production well. Additionally, as combustion occurs within the formation, the gases produced tend to increase the pressure in a region of the formation near the combustion front. The differential pressure which results within the formation will assist in moving remaining oil toward a region of lower pressure, such as a production well. Further, the combustion products which result from the in-situ combustion, such as flue gas, are known to be beneficial to the recovery of oil from a formation.

In-situ combustion, which utilizes an injected gaseous oxidant, can be utilized on various types of formations, including formations containing heavy oil, medium oil, or light oil. In-situ combustion provides an efficient means for improving the displacement efficiency of oil from a formation. However, the equipment utilized to inject the gaseous oxidant is typically expensive to install and maintain. Also, there is a tendency for the injected gaseous oxidant to sweep only the upper regions of vertically thick formations. Further, the technique is complicated and requires a detailed and complete understanding of the properties and characteristics of a reservoir to carry it out. The above factors make it impracticable to utilize an injected gaseous oxidant to create in-situ combustion within many formations.

U.S. Pat. No. 4,867,238 to Bayless et al., discloses another enhanced recovery technique which at least in part utilizes thermal energy to aid in recovering oil from a formation. The patent discloses the injection of a hydrogen peroxide solution into a formation containing viscous oil. The hydrogen peroxide decomposes by an exothermic reaction to produce oxygen and water. The oxygen produced is available to further react with oil contained in the formation to produce carbon dioxide, carbon monoxide, water, and heat. Hydrogen peroxide is expensive and requires special containers for storage and transport. Additionally, hydrogen peroxide is a highly reactive chemical which can corrode oil field tubulars. Further, it also may be difficult to control the decomposition of hydrogen peroxide within a typical formation.

What is desired is a method for recovering oil from a formation which provides a displacement efficiency similar to that characteristic of in-situ combustion techniques, together with the simplicity of operation characteristic of water flooding. The method should be capable of being utilized on formations which contain light, medium, or heavy oil.

As used herein, the following terms shall have the following meanings:

(a) "sweep" refers to the region of a formation contacted by the fluid introduced into the formation. The sweep of the formation is measured as a percentage of the formation contacted. With in-situ combustion, the total sweep results from introduced fluid and in-situ combustion products sweeping the formation. The total sweep is the product of the sweep in the areal and vertical directions;

(b) "flue gas" refers to the gaseous mixture which results from the combustion of a hydrocarbon with air. The exact chemical composition of flue gas depends on many variables, including but not limited to, the combusted hydrocarbon, the combustion process oxygen-to-fuel ratio, and the combustion temperature;

(c) "combustion" refers to a rapid exothermic reaction which occurs when hydrocarbons are reacted with an oxidant. When oxygen is the oxidant, the reactions typically produce carbon dioxide ($CO_2$), carbon monoxide (CO), and water ($H_2O$). The reactions may also produce nitrogen oxides, sulfur oxides, and other reaction products;

(d) "in-situ combustion" refers to combustion which occurs within a subterranean formation between oil contained within the formation and an oxidant;

(e) "heavy oil" is crude oil having an API gravity of less than 20° C.;

(f) "medium oil" is crude oil having an API gravity of between 20° and 30° C.;

(g) "light oil" is crude oil having an API gravity of greater than 30° C.;

(h) "decomposition temperature" is the temperature at which a substantial weight percentage of a salt introduced into the formation will begin to decompose and to generate an oxidant;

(i) "ignition temperature" is the temperature at which oil contained within a subterranean formation would be capable of igniting if provided with a sufficient quantity of a suitable oxidant; and (j) a "pore volume" refers to the open space in a rock formation not occupied by solid mineral matter.

SUMMARY OF THE INVENTION

It has been surprisingly discovered that a salt, such as ammonium nitrate, can be injected into a subterranean formation, which contains crude oil, to facilitate in-situ combustion within the formation. The salt is preferably contained in water that is injected into the formation. Within the formation, the salt is heated to a temperature which will cause it to decompose to generate an oxidant which can react with oil contained within the formation. Preferably, the salt decomposes to generate oxygen which can combust in-situ with oil contained within the formation. It has been surprisingly discovered that in-situ combustion can occur within the formation even though there is a large quantity of water within the formation relative to a small quantity of oil which is available to combust. The combustion products which result from the in-situ combustion of oil with generated oxygen will enhance the recovery of oil from the formation. The enhanced recovery is due, at least in part, to the gases generated during combustion pushing the oil toward a production well where it can be recovered. Additionally, the heat liberated by in-situ combustion will mobilize the oil and facilitate its movement toward a production well. Further, gases such as carbon dioxide will tend to dissolve into the oil and make it easier for the oil to be moved toward a production well. It is believed that by using the invention, 50 to 80% of the oil-in-place, just prior to commencing in-situ combustion, can be recovered from the formation.

One object of the invention is to provide an improved water injection process for recovering hydrocarbons from a subterranean formation, wherein the process utilizes a salt which is capable of decomposing to generate an oxidant.

Another object of the invention is to provide an improved water injection process for recovering hydrocarbons from a subterranean formation, wherein the process utilizes a salt which decomposes to generate oxygen.

Yet another object of the invention is to provide an improved water injection process for recovering hydrocarbons from a subterranean formation, wherein the process utilizes a water soluble salt which decomposes to generate an oxidant at a temperature above the reservoir temperature of the formation.

Yet a further object of the invention is to provide an improved process for recovering oil from a formation which utilizes air or oxygen injection together with an injected water soluble salt, which is capable of decomposing to generate an oxidant, to cause in-situ combustion to occur within the formation.

The present invention is directed to methods that satisfy the above described objects of the invention.

Numerous advantages and features of the present invention will become readily apparent from the following detailed description of the invention, the FIGS., the embodiments described therein, and the claims.

BRIEF DESCRIPTION OF THE DRAWINGS

FIG. 6 shows the effect of adding sand to the mixture of ammonium nitrate and crude oil.

DESCRIPTION OF THE EMBODIMENTS

Figure 1:
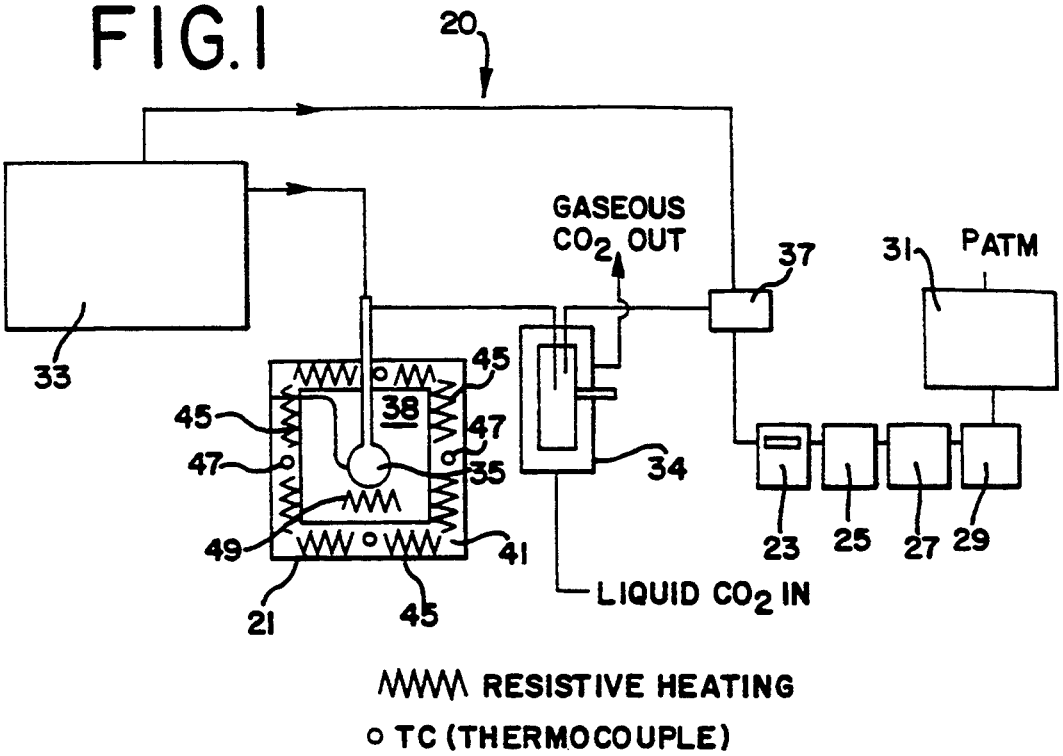
FIG. 1 is a schematic diagram of an accelerating rate calorimetry system.

While this invention is susceptible of embodiment in many different forms, there will herein be described in detail specific embodiments of the invention. It should be understood, however, that the present disclosure is to be considered an exemplification of the principles of the invention and is not intended to limit the invention to the specific embodiments illustrated.

In the current invention, water containing a salt, which is capable of decomposing to generate an oxidant, is introduced into a subterranean formation which contains crude oil. Decomposition conditions are established within the formation to cause the salt to decompose and generate an oxidant which can be combusted with at least a portion of the crude oil contained within the formation. The combustion products which result from the in-situ combustion and the heat generated will mobilize the remaining crude oil contained within the formation so that it can be recovered at a production well.

IGNITION PARAMETERS

In order to initiate and maintain combustion within a subterranean formation, conditions must be established within the formation which will promote combustion. The parameters which effect in-situ combustion within a formation are referred to hereinafter as "ignition parameters." The ignition parameters include, but are not limited to: the oxidant to be utilized, the availability of the oxidant utilized to react with the hydrocarbons contained within the formation, the quantity of oxidant available to react with the hydrocarbons, the type and amount of hydrocarbons present within the formation, the temperatures and pressures prevalent within the formation, the mineral composition of the formation, the degree of water saturation within the formation, the porosity of the formation, and the permeability of the formation. The parameters which must be established for ignition to occur within a formation are referred to as "ignition conditions."

In order for ignition to occur, a sufficient quantity of oxidant must be available to react with the crude oil present within the formation and the crude oil/oxidant mixture must be at or above the oils ignition temperature. With the current invention, at least a portion of the oxidant is provided by the decomposition of an injected salt. The salt will decompose to generate oxidant when "decomposition conditions" are established within the formation. Generally, decomposition conditions are established by increasing the temperature of the salt to a sufficient temperature to cause a substantial amount of the salt to decompose and generate an oxidant which is capable of combusting with the hydrocarbons present within the formation. The "decomposition temperature" is dependent on several variables including, but not limited to: the pressure within the formation, the concentration of salt contained in the water phase present within the formation, and the mineral composition of the formation.

The ignition conditions and decomposition conditions which are necessary to promote combustion within a formation preferably are determined using empirical data. Empirical data are preferably utilized to ensure that the methods and the type and amount of salt utilized will provide a sufficient quantity of oxidant to sustain in-situ combustion within the formation.

FIG. 1 is a schematic view of an instrument which can be utilized to determine the decomposition conditions and ignition conditions which will be required to sustain in-situ combustion within a formation. The instrument displayed in FIG. 1 is a type of "accelerating rate calorimetry system." The calorimetry system is capable of modeling reactions which occur within a subterranean formation as in-situ combustion is occurring within the formation. The calorimetry system 20 includes a calorimeter assembly 21 and gas analysis equipment, including a flow meter 23, an oxygen analyzer 25, a carbon dioxide analyzer 27, a carbon monoxide analyzer 29, and a mass spectrometer 31. The system 20 also includes a system 33 for establishing and maintaining a high pressure atmosphere within a spherical sample holder 35. The pressure can be maintained within the sample holder 35 during normal operations by use of a back-pressure regulator 37. This will allow combustion products to be removed from the spherical sample holder 35 as combustion is occurring, while still maintaining the pressure within the holder. This will allow more accurate modelling of the processes which are likely to occur within a subterranean formation during the practice of the invention. The calorimetry system also includes a high pressure separator 34 which separates the gases from the liquid before sending the gases to the gas analysis equipment. The separator 34 uses liquid carbon dioxide to condense liquid vapors and thereby separate the liquids from the gases.

Figure 2:
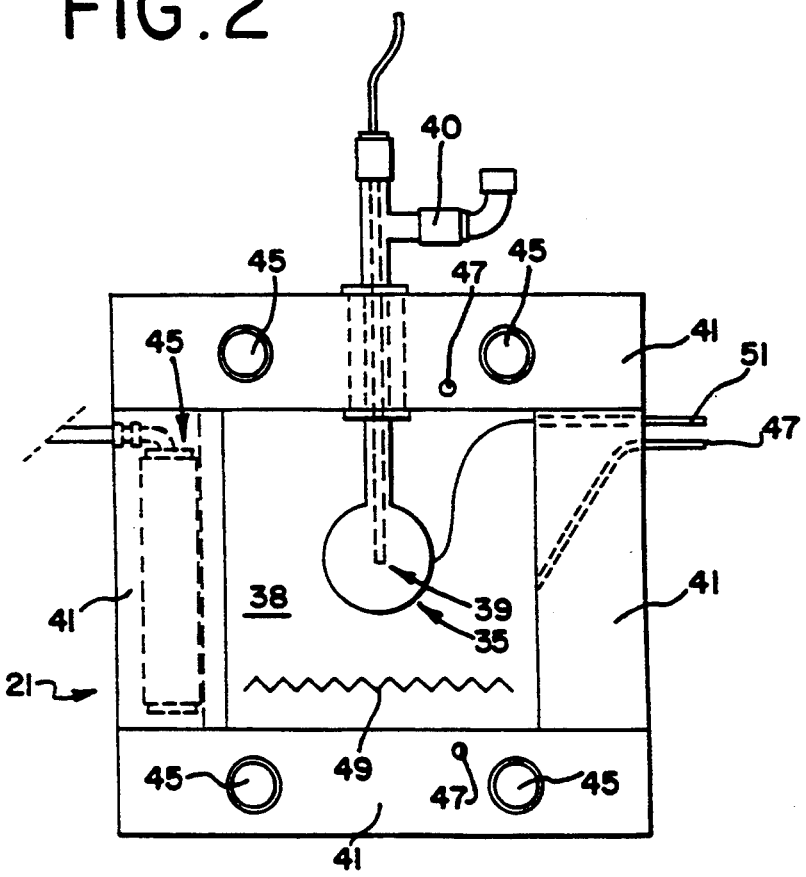
FIG. 2 is an elevational view of the calorimeter assembly of FIG. 1.

FIG. 2 is an elevational view of the calorimeter assembly 21 of FIG. 1. The assembly 21 is comprised of a 2.54 cm diameter spherical sample holder 35, which is designed to withstand pressures of up to 6000 p.s.i., and is rigidly suspended within a chamber 38. A 1.59 millimeter pressurization/injection line 39 is inserted into the sample holder 35 and is in fluid communication with the interior of the sample holder 35. A pressure transducer 40 senses the pressure present within the sample holder 35 during an experimental run. Embedded within the walls 41, which form the chamber 38, are cartridge type heaters 45 and thermocouples 47. The heaters 45 maintain adiabatic conditions within the calorimeter assembly 21, once an exothermic reaction has been detected within the sample holder 35. An exothermic reaction is detected by a thermocouple 51, which is attached to the sample holder 35. A radiant heater 49 is located within the chamber 38 at its base. The radiant heater 49 initially increases the temperature within the sample holder 35 until an exothermic reaction is detected. In addition to the components shown in FIGS. 1 and 2, the accelerating rate calorimetry system includes:

a power control module; an ice-point reference which provides all thermocouples with a reference 0° C. temperature; a control module for controlling the operation of the calorimetric system; a plotter for plotting the results of each experimental run; and a personal computer which receives input from the various components and sensors associated with the accelerating rate calorimetric system and processes the collected data.

Experimental runs performed using the accelerating rate calorimetric system are carried out in the following manner. The desired amount of water, which contains a salt capable of decomposing to generate an oxidant, and the desired amount crude oil are loaded into the sample holder 35. The proportion of salt to crude oil may be varied to simulate oxidant-rich and/or oxidant-lean conditions within a formation. Ammonium nitrate, which decomposes to generate oxygen, is the preferred salt utilized. Crude oil from the formation of interest is preferably utilized so that the results obtained are more representative of what occurs within the formation of interest. Since a subterranean formation contains sand or other mineral matter, it is preferable to add mineral matter, which is similar to that found in the reservoir of interest, to the sample holder 35. It is believed that the results obtained without sand will be similar to the results with sand, except the salt should decompose at a slightly higher temperature when sand is not present. Additionally, it is believed the rate of pressure change which is measured during a calorimetric system experimental run will be less when sand is present. It is believed this is a result of some of the energy released from the decomposition of the salt and the ensuing combustion of the crude oil being absorbed by the sand. The sand thereby acts as a damper which reduces the rate of pressure change which occurs during an experimental run.

After the reactants are loaded into the sample holder 35 and the calorimeter assembly 21 is assembled, helium is used to purge the air from above the sample holder 35. In addition to purging the air from the sample holder 35, the helium is also used to establish a pressure within the sample holder 35 which simulates the reservoir pressure of the formation of interest.

After the desired pressure has been reached, the radiant heater 49 is periodically energized to raise the temperature of the oil/water mixture. The temperature is raised in 5° C. steps from the reservoir temperature of the formation of interest, which typically ranges from 30° to 150° C., to the temperature at which an exothermic reaction is detectable within the sample holder 35. The heaters are typically energized for approximately 15 minutes during each "heating step," and each heating step is generally followed by a "wait step" which typically lasts for approximately 20 minutes and then a "search step" which typically lasts for approximately 30 minutes. The wait step allows any thermal transients created by the radiant heater 49 to dissipate. During the search step, the control system is closely monitoring the thermocouple 51 to determine if an exothermic reaction has commenced within the sample holder 35. Typically, an exothermic reaction is indicated when the self-heat rate during the search step is 0.02° C./minute or higher, as measured by thermocouple 51.

Once an exothermic reaction is detected, radiant heater 49 is not energized further. Thereafter, the reaction is allowed to continue to completion under adiabatic conditions. As the reaction proceeds, temperature, pressure, and gas composition data can be collected with time until the reaction is complete.

By plotting the temperature and pressure over time, the minimum decomposition temperature and the temperature range over which decomposition of the salt occurs can be determined; the heat release rate and pressure increase which will result within the formation can be determined; the reaction mechanism which will occur within the formation can be inferred; and kinetics parameters such as activation-energy and order of reaction can be calculated. The collected data can be used to determine the decomposition conditions and ignition conditions for a formation of interest. Additionally, the gas composition data can be used to determine the efficiency of the in-situ combustion which will occur within a formation.

By determining the decomposition conditions, the ignition conditions, and the efficiency of the in-situ combustion for the hydrocarbon of interest with a variety of different salts and various weight percentages of salt, one of ordinary skill in the art can determine which salt and what weight percent of that salt to utilize to recover most efficiently the hydrocarbons contained in a particular formation.

Figure 3:
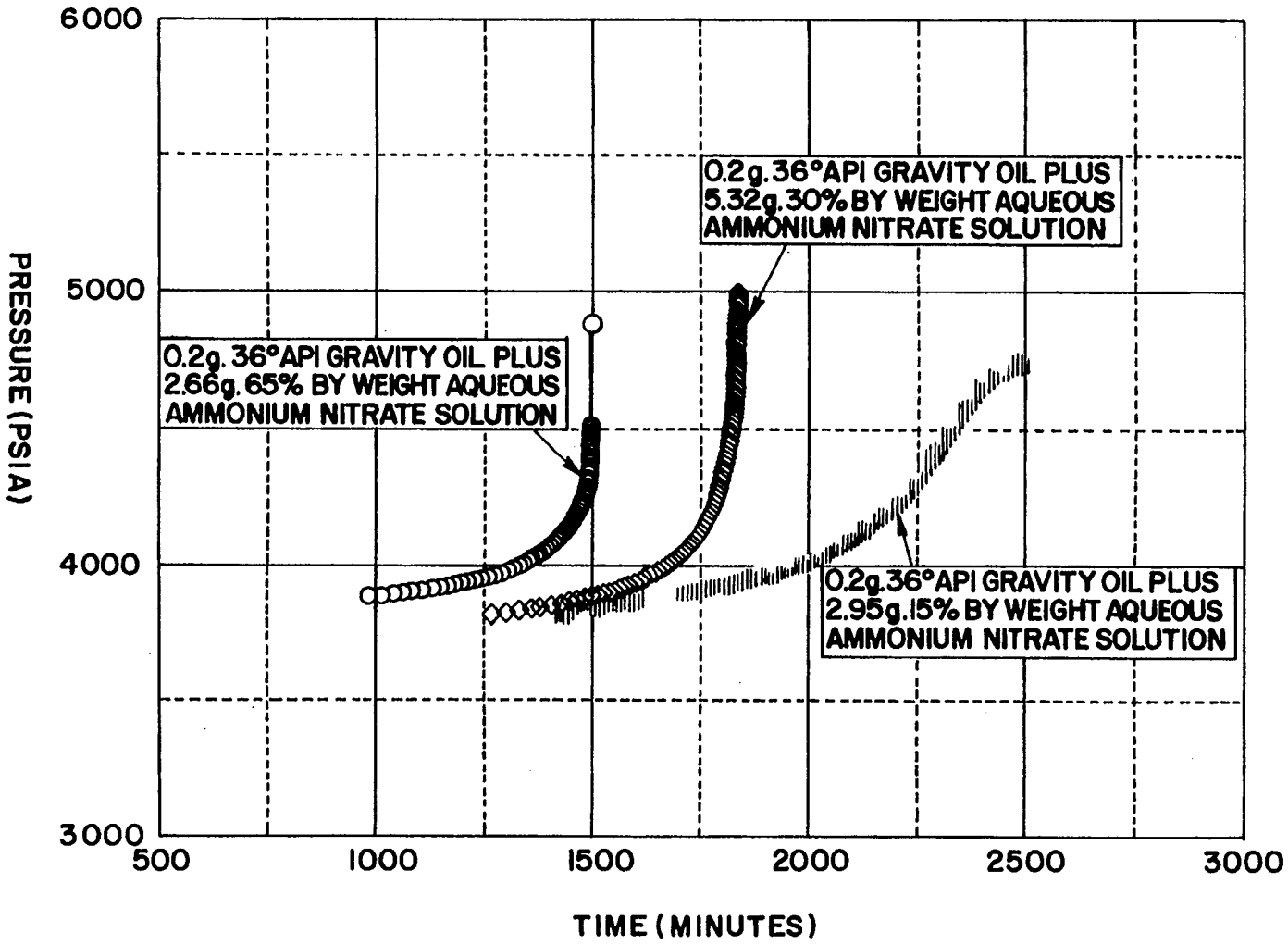
FIG. 3 is a graph of the pressure change which occurs over time within the sample holder of FIG. 2, as an ammonium nitrate solution and crude oil are heated to the decomposition temperature of the ammonium nitrate.
Figure 4:
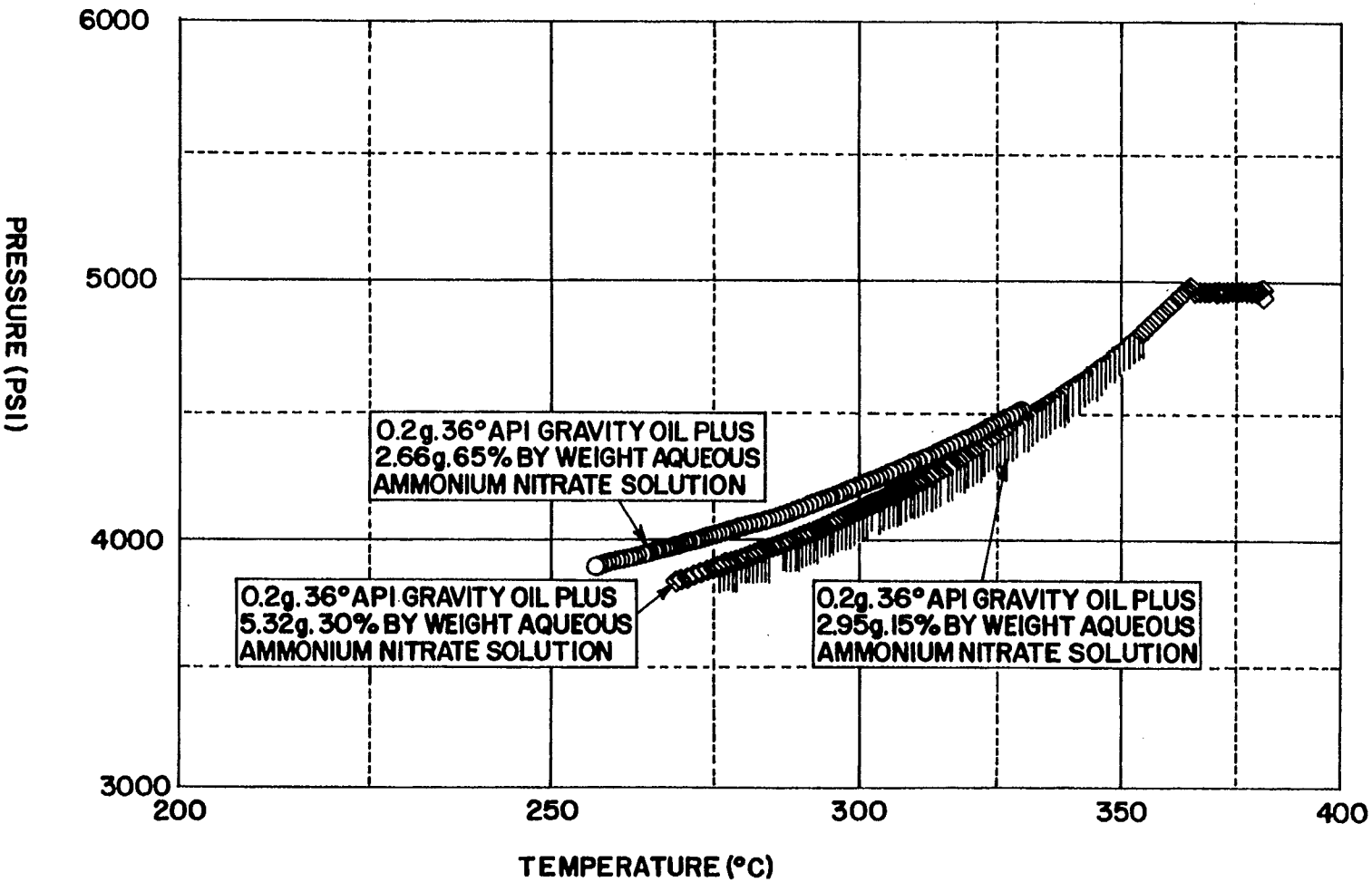
FIG. 4 is a graph of the pressure change versus temperature which occurs for the same experimental runs as shown in FIG. 3.

FIGS. 3 and 4 show the pressure change that occurs as a result of the combustion of crude oil with an oxidant provided by several different aqueous solutions which contain varying weight percentages of ammonium nitrate. For the experimental runs, the same volume of crude oil, having an API gravity of 36° C., was added to the sample holder 35 for each of the runs. As can be seen from FIG. 3, the pressure increase occurs earlier when aqueous solutions are utilized which contain a higher weight percentage of ammonium nitrate. Also, as can be seen from FIG. 4, the pressure increase occurs at a lower temperature when aqueous solutions which contain a higher weight percentage of ammonium nitrate are utilized.

Figure 5:
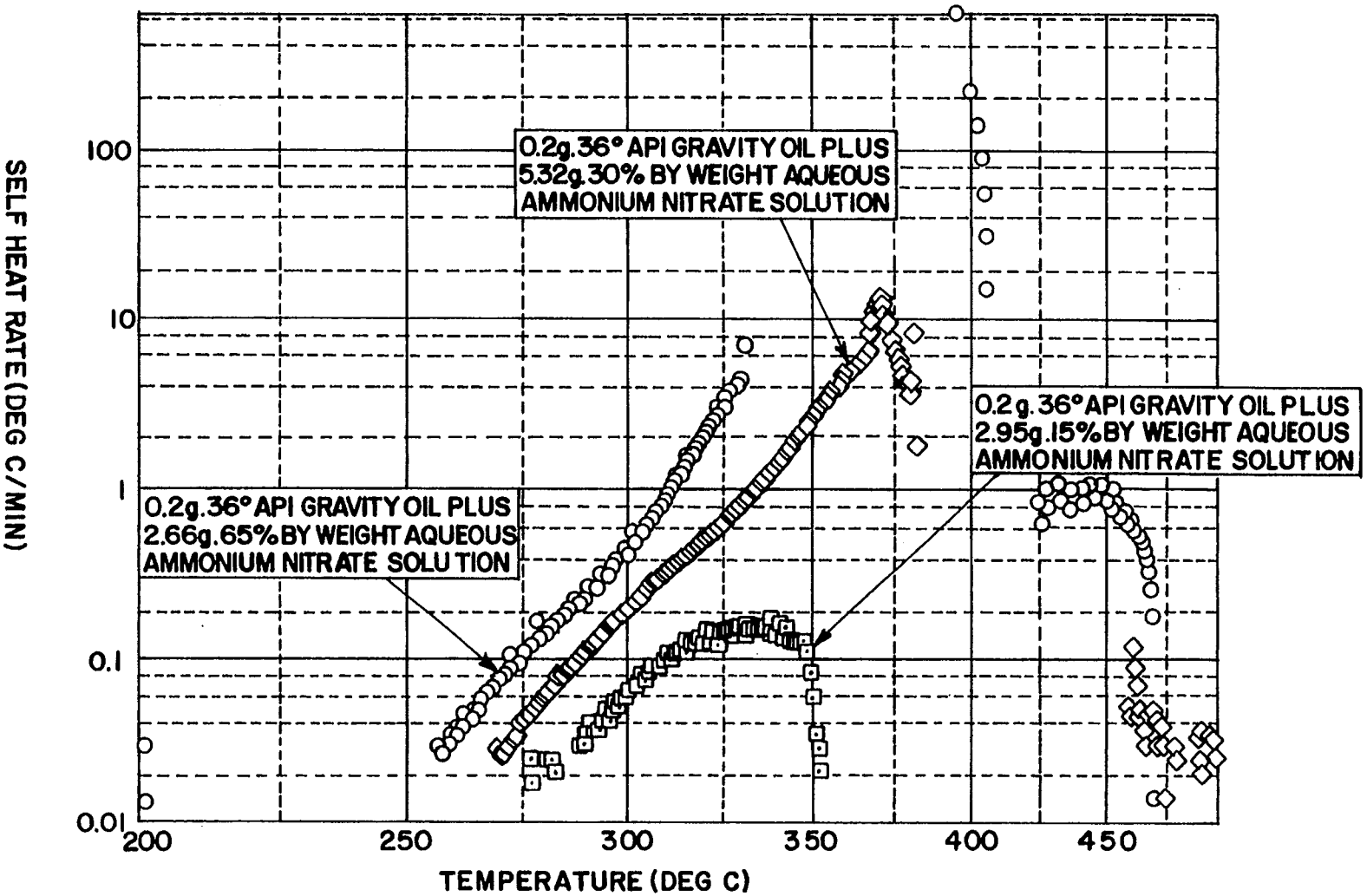
FIG. 5 is a graph of the self-heat rate versus temperature which results from the reaction of ammonium nitrate and crude oil.
Figure 6:
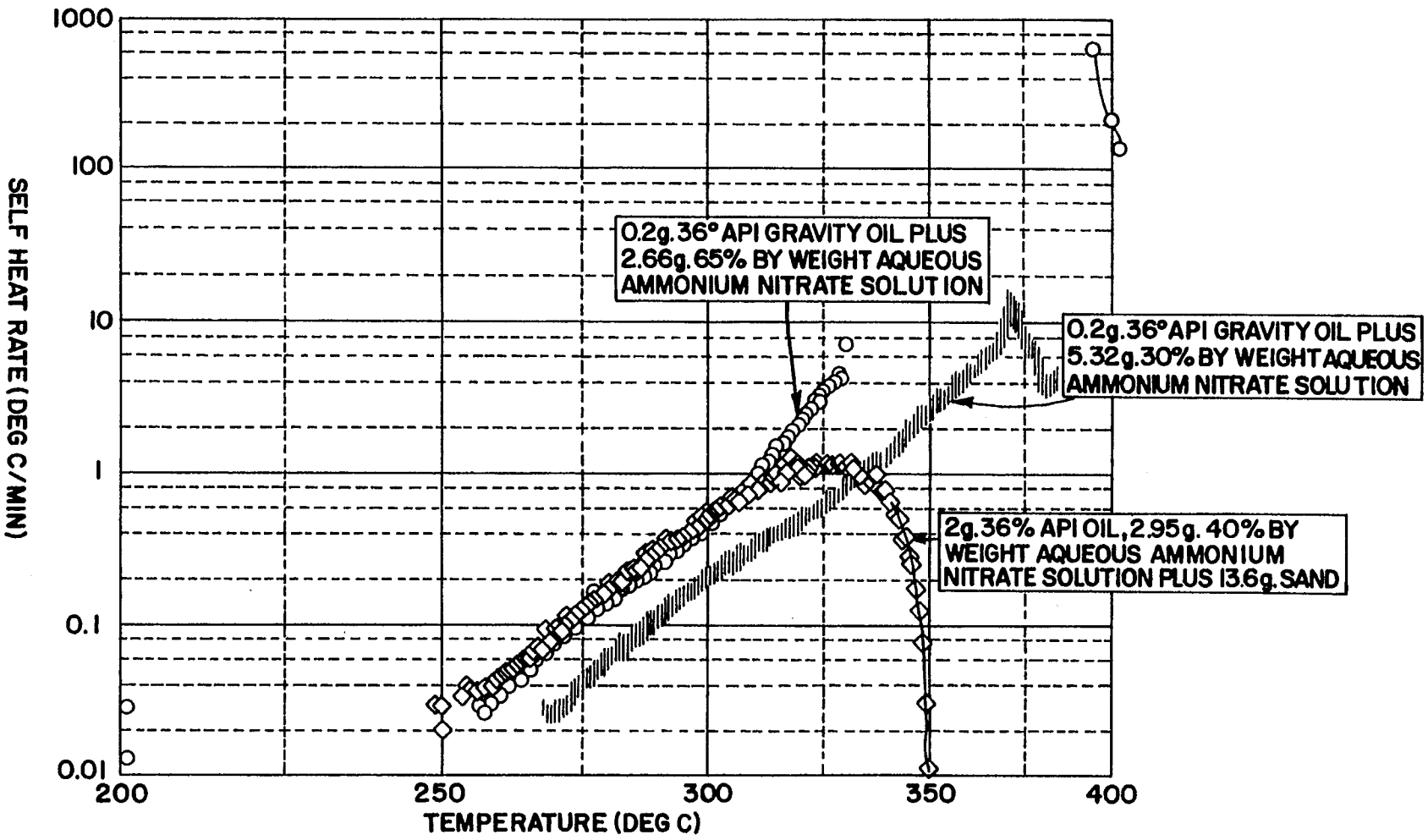
FIG. 6 is a graph of the self-heat rate versus temperature which results from the reaction of ammonium nitrate and crude oil.

FIGS. 5 and 6 are plots of the self-heat rate obtained for mixtures of crude oil and aqueous solutions having various concentrates of ammonium nitrate. As with FIGS. 3 and 4, the same volume of crude oil was added to the sample holder 35 for each of the runs. As can be seen from FIG. 5, the exothermic reactions commence at a lower temperature for aqueous solutions having higher concentrations of ammonium nitrate. Also, as can be seen from FIG. 6, the decomposition temperature is slightly reduced by the addition of sand to the mixture of crude oil and aqueous solution containing salt.

The calorimetry system disclosed can also be utilized to screen potential compounds for use as oxidants. Preferably, the salt utilized is capable of decomposing to generate free oxygen. Also, it is desirable to utilize a salt which will not substantially decompose at temperatures at or below the temperatures naturally prevalent within a typical reservoir. If a substantial weight percentage of the salt utilized decomposes to generate oxidant at temperatures at or below the temperatures naturally prevalent within a typical reservoir, the chance of uncontrolled combustion occurring increases. This causes a safety concern since combustion may spontaneously occur in wellbores, production equipment, or in the formation. Most preferably, the salt will not decompose to generate oxidant at a temperature less than 200° C. This will ensure a decomposition temperature greater than the reservoir temperature prevalent within most formations of interest.

In most instances, the decomposition temperature will be greater than the reservoir temperature prevalent within a formation and the ignition temperature will be achieved prior to the decomposition temperature being reached. In some instances, however, the decomposition temperature for the salt used may be less than the natural temperatures prevalent within a formation of interest. In these types of situations, the ignition temperature of the oil is preferably greater than the temperatures prevalent within the formation. This will minimize the probability of uncontrolled combustion occurring spontaneously within the formation, since the ignition temperature is greater than the temperature prevalent within the formation. In these situations, ignition will not occur until sufficient heat is added to the system by operator action to raise the hydrocarbon/oxidant mixture to the ignition temperature.

Preferably, the ignition temperature and decomposition temperature are both in the range achievable by the use of downhole burners, such as described in U.S. Pat. No. 3,497,000 to K. L. Hujsak et al., which is herein incorporated by reference, or other types of ignition devices which are typically utilized for initiating in-situ combustion and are known to one of ordinary skill in the art. A thorough discussion of ignition devices and their usage can be found in a paper entitled "Ignition Devices and Methods for In-Situ Combustion" by D. C. Shallcross, Stanford University Petroleum Research Institute, presented at III Simposio Internacional Sobre Recuperacion Mejorada de Crudo at Maracaibo, Venezuela, Feb. 19-22, 1989, which is hereby incorporated by reference for its teaching regarding how to heat the hydrocarbons and other compounds contained within a formation using a downhole burner.

Alternatively, chemicals, such as peroxides, can be utilized in lieu of downhole burners to raise the salt and/or hydrocarbon within the formation to a sufficient temperature to promote combustion of the oxidant produced by the decomposition of the salt with the crude oil contained within a formation.

In another aspect, which is more fully discussed below, a gas containing oxygen is introduced into the formation. Ignition parameters are then established within the formation and in-situ combustion is commenced. The in-situ combustion of the oxygen containing gas and hydrocarbons provides the heat required to decompose the salt introduced into the formation to generate oxidant. The generated oxidant will then combust with hydrocarbons contained within the formation.

The methods utilized to heat the salt and hydrocarbon do not necessarily need to heat the whole formation, they only need to heat enough of the salt and hydrocarbon to cause ignition. A combustion front can then propagate through the formation and enhance the recovery of hydrocarbons.

Typically, the ignition temperature and the decomposition temperature are from 50° to 400° C. As discussed earlier, a decomposition temperature of greater than 200° C. will minimize the chance of ignition occurring within most formations between generated oxidant and oil-in-place without deliberate operator action being taken to establish decomposition conditions within the formation.

The salt utilized preferably is soluble in water and is preferably not highly reactive or explosive in the presence of water. A high solubility in water will make it possible to efficiently transport a large quantity of salt into the formation. Preferably, the salt utilized should be capable of forming an aqueous solution having a weight percentage of salt of from 1 to 70 percent. The salts which may be utilized in the current invention include but are not limited to nitrates, perchlorates, and chlorates.

An example of a salt which can be utilized in the invention is ammonium nitrate. Ammonium nitrate is preferably utilized for several reasons, including: 1) its chemical stability in water at the conditions prevalent within a typical formation; 2) its ready availability and relative inexpensiveness; 3) its high solubility in water, having a maximum solubility of about 118 grams of $NH_4NO_3$ in 100 grams of water at 0° C. and 843 grams of $NH_4NO_3$ in 100 grams of water at 100° C.; and 4) its ability to decompose in order to generate an oxidant at temperatures of approximately 250° C.

Ammonium nitrate is believed to decompose according to the following reactions:

$$NH_4NO_3 \rightarrow N_2O + 2H_2O \quad (1)$$

$$NH_4NO_3 \rightarrow N_2 + 2H_2O + 1/2O_2 \quad (2)$$

It is believed that the reaction described in equation (1) begins to occur as the temperature approaches 250° C. and is favored at temperatures near 250° C. The reaction described in equation (2) is favored at temperatures greater than approximately 250° C. Both equations (1) and (2) describe exothermic reactions which liberate heat which will be transferred to the crude oil contained within the formation. Additionally, both reactions produce oxidants ($N_2O$ and $O_2$) which are capable of supporting in-situ combustion. It is believed that the reaction described by equation (2) dominates when in-situ combustion is occurring within the formation. The combustion products which result from the reaction of the oxygen with a portion of the oil-in-place include carbon dioxide, carbon monoxide, water, steam, and heat.

The gases which are released by the decomposition of the salt and the in-situ combustion of oxidant with oil-in-place will tend to increase the pressure within the formation. The increase in pressure will assist in moving the oil contained within the formation toward a production well. Additionally, it is believed the in-situ combustion will produce a heat front which will vaporize a portion of the crude oil, thereby mobilizing it so that it can be moved toward a production well. Further, the combustion products and liberated heat will lower the viscosity of the remaining oil. Combustion products, such as carbon dioxide, will dissolve into the remaining oil contained within the formation, thereby lowering the viscosity of the remaining oil and causing the remaining oil to become more miscible in water. The above described effects will all enhance the recovery of oil from the formation.

UTILIZATION

In one embodiment of the invention, a salt, which can decompose to generate an oxidant, is utilized in the enhanced recovery of hydrocarbons from an underground formation which contains medium to light oil. Typically, only about 10 to 60 percent of the original oil-in-place can be recovered from a formation containing light oil by using pressure depletion and conventional water flood technology. It is believed that an additional 50 to 80 percent of the oil-in-place, just prior to commencing in-situ combustion, can be recovered from such a formation using the current invention. As discussed above, the enhanced recovery is a result of the heat and combustion products produced by the decomposition of the salt and the subsequent in-situ combustion of oxidant with oil-in-place. The gases evolved due to the decomposition of the salt and the in-situ combustion of oil with the oxidant generated will tend to repressurize the formation. This will enhance the recovery of oil from the formation. The repressurization begins locally, with a pressure peak near the decomposition/combustion front, but becomes widespread within the formation as a pressure wave spreads throughout the formation. The amount of repressurization which occurs within a formation depends on the size of the formation, its porosity, its permeability, the initial reservoir pressure of the formation present prior to introducing the salt, and the fraction of the pore space within the formation which is occupied by the introduced salt. It is preferable to raise the pressure within the formation by 50 to 2500 p.s.i., more preferably by 500 to 2000 p.s.i.

In this embodiment of the invention, water, which preferably contains from 1 to about 90 percent by weight of a salt which can decompose to generate an oxidant, more preferably 10 to 65 percent by weight, most preferably 15 to 40 percent by weight, is introduced into the formation through an injection well. Within the formation, decomposition conditions are established to cause the salt to decompose to generate oxidant, preferably oxygen. As discussed earlier, decomposition conditions can be established by heating the salt to its decomposition temperature. This is typically accomplished by introducing hot gases into the formation. Alternatively, if the temperature within the formation is sufficient to support ignition, air may be introduced into the formation to cause in-situ combustion to occur between the injected air and a portion of the oil-in-place. The heat released by in-situ combustion of in-place hydrocarbons with introduced air will establish the required decomposition conditions within the formation. The generated oxidant will react with the oil-in-place within the formation to cause in-situ combustion to occur between the oil-in-place and the generated oxidant.

If ammonium nitrate is utilized, about 1 kg of oil-in-place will be combusted for every 17 kg of ammonium nitrate introduced into the formation. For a given weight of ammonium nitrate utilized, the volume of oil-in-place combusted generally increases with increasing API gravity. It is desirable to minimize the amount of oil-in-place which must be combusted to recover a given amount of crude oil from the formation.

The production well or wells are preferably monitored as the method progresses. The parameters which may be monitored include, but are not limited to: the composition of the effluent recovered from a production well or wells, including the composition of gases produced from the formation; the temperature within the formation, especially in the regions where combustion is occurring; and the pressure within the formation. By monitoring these and other parameters, it can be determined if the oxidant is being efficiently produced and utilized within the formation. For example, the concentration of carbon monoxide recovered from a production well should increase if the amount of oxidant provided is insufficient. Also, an increasing concentration of salt, such as ammonium nitrate contained in the effluent indicates that the salt is not being efficiently decomposed within the formation or that too much salt is being introduced into the formation.

The water containing a salt which can decompose to generate an oxidant can be introduced either continuously or intermittently. If the water solution is to be introduced intermittently, a desired quantity of solution is typically emplaced in the formation prior to the establishment of decomposition conditions and/or ignition conditions within the formation. Once in-situ combustion is initiated within the formation, the combustion front created will tend to move forward through the formation. When the water is introduced continuously, the decomposition and/or ignition conditions are typically established as the water solution is introduced into the formation. When the salt is emplaced in the formation prior to establishing decomposition and/or ignition conditions, from about 0.05 to 1.0 pore volumes of water containing the salt is emplaced within the formation, more preferably from 0.1 to 0.5 pore volumes.

In this embodiment of the invention, the water solution should be introduced in a manner which maximizes the vertical and horizontal sweep of the formation. In one aspect of this embodiment, air or oxygen is also introduced into the formation, either intermittently or continuously, under conditions which will result in the in-situ combustion of the introduced air with oil-in-place. In this aspect, the introduced air will tend to sweep the upper portion of the formation, while the introduced water tends to sweep the lower portion of the formation. It is believed the introduction of a salt which can generate an oxidant in conjunction with the introduction of air or oxygen will increase the sweep which occurs within some formations. The introduction of air and water containing salt can occur concurrently or they can be staggered.

In another aspect of this embodiment, the water containing the salt is introduced into a field which has undergone enhanced recovery using an injected gaseous fluid, such as carbon dioxide. It is believed that the in-situ combustion which occurs as a result of the oxidant generated by the introduced salt solution will efficiently sweep those areas of the formation which were bypassed by the injected gaseous fluid.

In a second embodiment of the invention, the salt which can decompose to generate an oxidant is utilized to enhance the recovery of hydrocarbons from an underground formation which contains heavy oil. In general, heavy oil needs to be heated to lower its viscosity so that it may be efficiently recovered from a formation.

The water containing the salt is preferably introduced into a lower water layer, which often underlies a heavy oil layer contained within the formation. Preferably, the desired quantity of water containing salt is emplaced within the formation prior to establishing decomposition conditions within the formation. The amount of water to be placed within the formation can be estimated from the porosity and permeability of the formation. The amount of water containing the salt to be emplaced in the formation prior to establishing decomposition and/or ignition conditions is preferably from about 0.05 to 1.0 pore volumes, more preferably from 0.1 to 0.5 pore volumes. The amount of water which is to be emplaced within a formation can also be determined by monitoring the effluents recovered from a production well as water is being introduced into the formation. The quantity of salt, such as ammonium nitrate, contained within the effluent recovered from a production well will increase dramatically, when the free pore spaces within the formation are filled with water containing the salt. The introduced water preferably contains from 1 to about 70 percent by weight of the salt which can decompose to generate an oxidant, more preferably 10 to 65 percent by weight, most preferably 15 to 40 percent by weight.

The decomposition conditions and ignition conditions can be established by methods similar to those used for formations containing light and medium oil. It is believed that most of the combustion which occurs as a result of the reaction between the generated oxidant and the heavy oil will occur at the boundary layer between the water layer and the heavy oil layer which exists within many formations containing heavy oil. The heat and combustion products produced will tend to rise vertically within the formation, thereby reducing the viscosity of the heavy oil contained within the formation. This will allow the heavy oil to be more easily moved toward a production well where it can be recovered. Also, as with light and medium oil, at least a portion of the heavy oil will be vaporized by the heat front and thereby mobilized within the formation.

As with formations containing light and medium oil, it may be advantageous to also inject air or oxygen into the formation either continuously or intermittently to cause in-situ combustion between the injected air and oil-in-place. This should enhance the sweep which occurs within some formations. As is the case with formations containing light and medium oils, the introduced air will tend to sweep the upper portions of the formation, while the water will tend to sweep the lower portion of the formation, especially if the formation has a water layer which underlays the oil layer.

In all embodiments of the invention, the in-situ combustion which occurs can be controlled by adjusting the concentration of the salt contained within the water introduced into the formation. By controlling the concentration of the salt, the amount and rate of combustion which occurs within the formation can be moderated. This in turn will control the temperatures and pressures present within the formation. In general, the amount of salt utilized should result in the greatest amount of gases and/or heat being released into the formation for a given amount of salt utilized. It must be remembered that heat may be released both from the decomposition of the salt and as a result of the in-situ combustion of oil-in-place. As discussed earlier, it is believed that from 50 to 80% of the oil-in-place can be recovered from a formation using the invention. The oil-in-place prior to using the invention will be lower than the original oil-in-place if oil has been recovered from the formation prior to commencing in-situ combustion using the invention. It is believed that from 50 to 90% of the original oil-in-place can be recovered from a formation if the invention is utilized on a formation which has previously undergone primary depletion and water flooding.

As discussed earlier, it may be desirable to maintain either a continuous combustion process or in some situations, such as heavy oil recovery, to utilize an intermittent combustion process.

EXAMPLE

In this example a combustion tube was used to model the in-situ combustion which will occur within a subterranean formation. The combustion tube simulates the propagation of a combustion front within the formation and the associated dynamic reaction kinetics, under conditions which closely approximate the conditions which are present within a subterranean formation.

Figure 7:
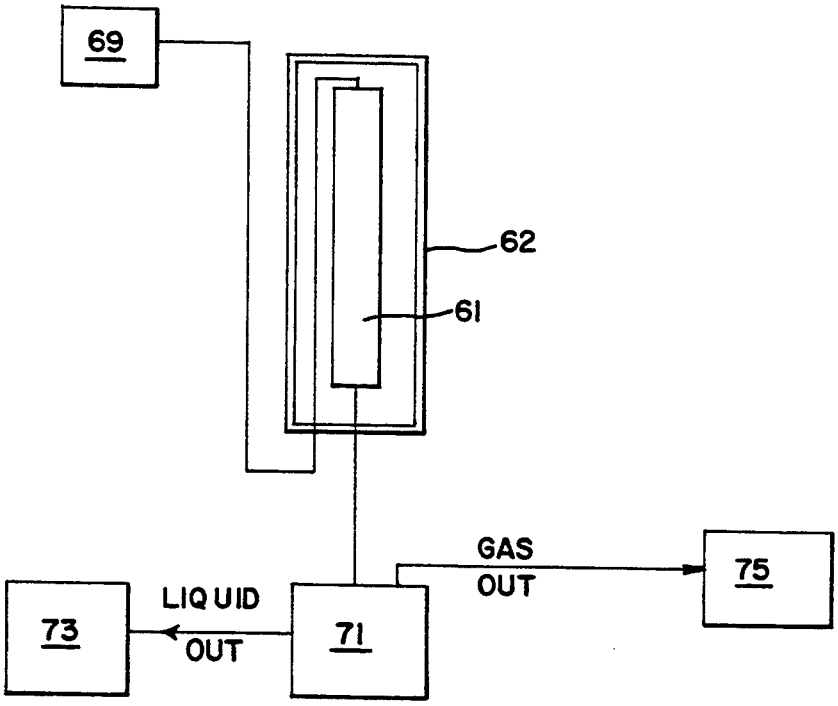
FIG. 7 is a schematic diagram of a combustion tube system used to model the in-situ combustion which occurs between an oxidant, generated by the decomposition of a salt as utilized by the invention, and crude oil.

Referring to FIG. 7, a combustion tube 61, which is constructed of inconel, is schematically shown together with its associated auxiliary equipment. The combustion tube 61 is 1.83 meters long with a 7.62 cm inner diameter and is located within pressure vessel 62. A fluid delivery system 69 is connected to the tube 61. The fluid delivery system 69 is capable of providing gas and/or liquid to the combustion tube 61 either at a constant metered rate or at a net constant pressure.

Fluids produced from the combustion tube 61 are sent through a high pressure separator 71, which separates the gas from the liquid phase. The liquids are collected and stored for later analysis by the liquid collection system 73. A gas analysis system 75 continuously monitors the concentration of CO, $CO_2$, and $O_2$ in the gases produced from the combustion tube 61. Additionally, the volume of gases produced from the combustion tube 61 are volumetrically measured by the gas analysis equipment 75. The gas analysis equipment 75 includes a magnetic sector mass spectrometer, infrared CO and $CO_2$ detectors, a paramagnetic $O_2$ analyzer, and a gas flow meter.

Figure 8:
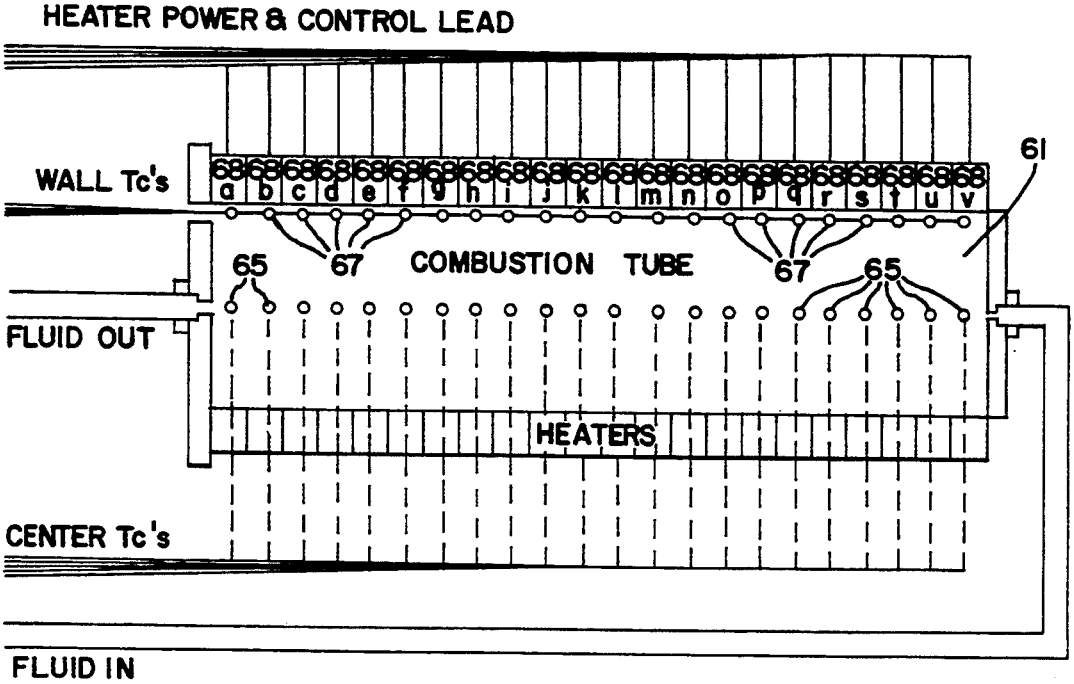
FIG. 8 is a schematic diagram of the combustion tube as used in the combustion tube system of FIG. 7.

Referring to FIG. 8, the combustion tube 61 has twenty two separate zones. Each zone is individually monitored and controlled. Each zone has a first thermocouple 65 which is located at the centerline of the combustion tube 61 within the sandpack and a second thermocouple 67 which is located near the combustion tube wall. Individual heaters 68 *a–v* located external to the combustion tube surround each zone.

At least one of the heaters 68–*v*, which are independently controlled, is used to raise the temperature within a zone to a temperature which initiates decomposition of the ammonium nitrate. The decomposition of ammonium nitrate generates an oxidant, which will react with the oil-in-place and cause in-situ combustion to occur initially within the zone and subsequently to advance into successively adjacent zones. Once in-situ combustion commences within the combustion tube, the heaters 68 *a–v* maintain adiabatic conditions within the tube 61. This is accomplished by maintaining the temperature of the wall segment of each zone within 2.8° C. of the associated centerline temperature of that zone.

The combustion tube experimental run was conducted in the following manner. First, the interior of the tube 61 was packed with cleaned, crushed, reservoir core (68% quartz, 23% feldspars, 4% calcite/dolomite, and 5% clays) and saturated with synthetic reservoir brine (40.5 g of NaCl+19.7 g of $NaHCO_3$+7.1 g of $Na_2SO_4$+1 g $CaCl_2.2H_2O$+10,000 g distilled water). In general, the core material utilized is selected so that the sandpack will have a similar mineralogical composition as the subterranean formation of interest. Typically, reservoir core from the formation of interest should be utilized if it is available. The permeability of the sandpack was initially determined to be about one Darcy and the sandpack pore volume was determined to be about 2,555 cc. The brine was displaced by crude oil (36° C. API gravity) to an immobile brine saturation endpoint with resulting saturations of 65% oil and 35% brine. Temperature and pressure were raised to 121° C. and 3,500 psig to simulate the reservoir conditions present within the formation of interest. Initially, the combustion tube underwent a nitrogen flood at the rate of 80 SLPH (standard liters per hour) to simulate the rapid movement of gases ahead of a combustion front and to establish recovery due to gasflooding alone. 619 cc of oil were produced under the nitrogen gasflood. When oil production ceased under gas flooding conditions, oil saturation was 41% of the sandpack pore volume. Nitrogen injection was discontinued and ammonium nitrate solution injection was commenced. At this point in the test, all the oil that can be produced by gasflooding has been produced. Any further oil recovery will be due to decomposition of the ammonium nitrate and the subsequent in-situ combustion of the in-place oil with the oxygen generated by the decomposition of the ammonium nitrate.

The ammonium nitrate solution used for this experimental run was 60% by weight ammonium nitrate in distilled water. If this solution is injected at the rate of 10 cc/min and reacted in-situ, it produces oxygen equivalent to 323 SLPH air. The initial ammonium nitrate injection rate was 2 cc/min of ammonium nitrate solution. Three heaters 68*a, b*, and *c* were initially energized to raise the temperature within zones 64*a, b*, and *c* to 250° C. or above to cause decomposition of the ammonium nitrate. After 25 minutes the injection rate was raised to 5 cc/min and after another 75 minutes the ammonium nitrate injection rate was raised to 10 cc/min and held there for the next 3 hrs. and 20 min. until test termination.

During a combustion tube run, the following data are typically recorded as a function of time.

1. centerline and wall temperature for each zone;
2. heater output as a percentage of maximum output;
3. cumulative produced gas volume;
4. injected liquid volume;
5. produced oil volume;
6. produced water volume;
7. composition of produced gas;
8. inlet to and outlet pressures from the combustion tube;
9. produced oil density, viscosity, acid number, and chromatographic analysis; and
10. pH and chemical analysis of produced water.

Favorable results obtained from this experimental run included: (1) production of an additional 761 cc oil under the action of ammonium nitrate injection and in-situ combustion (73% of the oil-in-place at the start of ammonium nitrate injection); (2) production of an additional 2,095 cc water under the action of ammonium nitrate injection and in-situ combustion; (3) continuous production of $N_2$, $CO_2$ and CO, indicating continuous in-situ combustion; and (4) temperatures measured at the core of the sandpack exceeding reservoir temperature by 100°–150° C., indicating substantial heat generation by the exothermic reactions occurring within the combustion tube.

In general, using the data obtainable from combustion tube runs and the data which can be collected from accelerated rate calorimeter runs, the following can be determined for a formation of interest: the amount of oil-in-place combusted for a given amount of salt utilized, how a combustion front will move within a formation, the percentage of oil-in-place recoverable using the invention, the approximate cost of utilizing the invention on a given subterranean formation, the weight percentage of salt in water which will most efficiently recover hydrocarbons from the formation, the rate of water injection to be used if continuous injection of salt containing water is utilized, and the quantity of salt which should be used to maximize the recovery of oil-in-place from the formation.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made and materials may be substituted for those described. For example, microdispersions of solids which are capable of decomposing to generate an oxidant may be utilized to generate the oxidant necessary for in-situ combustion within a formation. Additionally, an injected salt solution, which decomposes to generate an oxidant, may be utilized to enhance the recovery from formations which contain other types of hydrocarbons, for example, condensate reservoirs or formations which are comprised of oil or tar sands.

Thus, it will be appreciated that various modifications, alternatives, variations, etc., may be made without departing from the spirit and scope of the invention as defined in the appended claims. It is, of course, intended that all such modifications are covered by the appended claims.

We claim:

1. A method for recovering crude oil from a subterranean formation, the method comprising the step of introducing water, containing ammonium nitrate, into the formation under decomposition conditions that will cause at least a portion of the ammonium nitrate to decompose to generate an oxidant which will combust with at least a portion of a crude oil contained within the formation to cause crude oil to be mobilized within the formation and to be recovered from a production well.

2. The method of claim 1, wherein the introduced water is comprised of about 10 to 65 percent by weight ammonium nitrate.

3. The method of claim 1, wherein the introduced water is comprised of from about 15 to 40 percent by weight ammonium nitrate.

4. The method of claim 1, wherein a sufficient quantity of ammonium nitrate is introduced into the formation to pressurize a region of the formation near a combustion front by about 50 to 2500 p.s.i.

5. The method of claim 1, wherein a sufficient quantity of ammonium nitrate is introduced into the formation to pressurize a region of the formation near a combustion front by about 500 to 2000 p.s.i.

6. A method for recovering crude oil from a subterranean formation, the method comprising the steps of:

a) injecting an aqueous solution containing ammonium nitrate into the formation through an injection well;
b) establishing decomposition conditions within the formation to cause in-situ combustion within the formation; and
c) recovering crude oil from a production well.

7. The method of claim 6, wherein the crude oil recovered comprises oil having an API gravity of at least 20° C.

8. The method of claim 7, further comprising:

d) injecting a gaseous oxidant into the formation; and
e) establishing ignition conditions within the formation to cause in-situ combustion between the injected gaseous oxidant and at least a portion of the crude oil contained within the formation.

9. The method of claim 8, wherein the gaseous oxidant is injected into the formation and injection conditions are established within the formation prior to step a).

10. The method of claim 6, wherein the crude oil recovered comprises oil having an API gravity of less than 20° C.

11. The method of claim 10, wherein from about 0.1 to 0.5 pore volumes of the aqueous solution is injected into the formation in step a) prior to establishing the decomposition conditions in step b).

12. The method of claim 6, wherein the ammonium nitrate has a decomposition temperature which is greater than the natural reservoir temperature of the formation.

13. The method of claim 12, further comprising:

d) predicting the decomposition conditions and the ignition conditions for the ammonium nitrate within the formation using an accelerating rate calorimetry system.

14. A method for recovering crude oil from a formation which has undergone enhanced recovery using a gaseous fluid comprising carbon dioxide, the method comprising the steps of:

a) injecting an aqueous solution containing ammonium nitrate into the formation through an injection well;

b) establishing decomposition conditions within the formation to cause in-situ combustion within the formation; and c) recovering crude oil from a production well.

15. The method of claim 14, wherein from about 50 to 80% of the oil-in-place present just prior to commencing step a) is recovered from the formation during step c).

16. The method of claim 14, wherein the decomposition temperature for the ammonium nitrate aqueous solution is at least 200° C.

* * * * *

UNITED STATES PATENT AND TRADEMARK OFFICE

CERTIFICATE OF CORRECTION

PATENT NO. : 5,443,118

DATED : August 22, 1995

INVENTOR(S) : Demetrios V. Yannimaras, et al

It is certified that error appears in the above-indentified patent and that said Letters Patent is hereby corrected as shown below:

| Col. | Line | |
|---|---|---|
| 1 | 31-32 | "These methods are sometimes hereinafter referred to as "recovery techniques." " should read --These methods are sometimes hereinafter referred to as "enhanced recovery techniques."-- |

Signed and Sealed this

Fifth Day of December, 1995

Bruce Lehman

*Attest:*

BRUCE LEHMAN

*Attesting Officer*

*Commissioner of Patents and Trademarks*